US009272891B2

(12) United States Patent
Arellano et al.

(10) Patent No.: US 9,272,891 B2
(45) Date of Patent: Mar. 1, 2016

(54) BEVERAGE-OPENING TOOL

(71) Applicant: Raging Mammoth, LLC, Jackson, WY (US)

(72) Inventors: Scott Arellano, Jackson, WY (US); Wyatt Thurston, Jackson, WY (US)

(73) Assignee: Raging Mammoth, LLC, Jackson, WY (US)

( * ) Notice: Subject to any disclaimer, the term of this patent is extended or adjusted under 35 U.S.C. 154(b) by 0 days.

(21) Appl. No.: 14/515,790

(22) Filed: Oct. 16, 2014

(65) Prior Publication Data

US 2015/0101200 A1 Apr. 16, 2015

Related U.S. Application Data

(60) Provisional application No. 61/891,808, filed on Oct. 16, 2013.

(51) Int. Cl.
*B67B 7/00* (2006.01)

(52) U.S. Cl.
CPC ..... *B67B 7/24* (2013.01); *Y10T 83/0481* (2015.04)

(58) Field of Classification Search
CPC ..... B67B 7/16; B67B 7/30; B67B 7/24; B67B 2007/166; B67B 2007/303
USPC ..... 81/3.57, 3.27, 3.55; 7/151, 152, 153; D8/18, 40; 30/412–414
See application file for complete search history.

(56) References Cited

U.S. PATENT DOCUMENTS

| | | | | | |
|---|---|---|---|---|---|
| 140,088 | A | * | 6/1873 | Smith | 30/413 |
| 540,857 | A | * | 6/1895 | Franken | 30/413 |
| 862,710 | A | * | 8/1907 | Codville | 30/413 |
| 863,652 | A | * | 8/1907 | Ross | 30/414 |
| 1,267,154 | A | * | 5/1918 | Whitaker | 81/3.57 |
| 1,280,746 | A | * | 10/1918 | Jakubec | 30/413 |
| D54,364 | S | * | 2/1920 | Anderson et al. | 7/152 |
| 1,550,761 | A | * | 8/1925 | Tanner | 7/152 |
| 1,610,347 | A | * | 12/1926 | Wolfe | 81/3.57 |
| 1,699,329 | A | * | 1/1929 | Enderes | 30/413 |
| D91,134 | S | * | 12/1933 | Gioscio | D8/18 |
| 2,049,116 | A | * | 7/1936 | Harris | 30/414 |
| 2,106,639 | A | * | 1/1938 | Jenkinson | D8/40 |
| D119,965 | S | * | 4/1940 | Paolantonio | D8/40 |
| 2,280,336 | A | * | 4/1942 | Maihack | D8/34 |
| 2,292,452 | A | * | 8/1942 | Kulling | 30/413 |
| 2,455,496 | A | * | 12/1948 | Kaskouras | 30/413 |
| 2,542,329 | A | * | 2/1951 | Hammond, Jr. | 81/3.57 |
| 2,621,550 | A | * | 12/1952 | Bach | 81/3.57 |
| D173,606 | S | * | 12/1954 | Belpedio et al. | D8/18 |
| 2,697,275 | A | * | 12/1954 | Moyle | 7/152 |

(Continued)

FOREIGN PATENT DOCUMENTS

| | | | | |
|---|---|---|---|---|
| DE | 3317791 | A1 | * | 5/1984 |
| FR | 1047617 | A | * | 12/1953 |

(Continued)

*Primary Examiner* — Jason Daniel Prone
(74) *Attorney, Agent, or Firm* — Snell & Wilmer L.L.P.

(57) ABSTRACT

A beverage-opening tool is provided. The tool may have a puncturing edge that can be positioned in contact with a beverage can and may penetrate the beverage can. In this manner, the beverage can may be opened. The tool may also have a tooth portion that can be positioned in contact with a bottle cap of a beverage bottle and can be used to remove the beverage cap. In this manner, the beverage bottle may be opened.

7 Claims, 10 Drawing Sheets

(56) References Cited

U.S. PATENT DOCUMENTS

| | | | | | |
|---|---|---|---|---|---|
| 2,858,721 | A | * | 11/1958 | Horne, Jr. | 7/152 |
| 3,153,851 | A | * | 10/1964 | Kazuo | D8/18 |
| D202,208 | S | * | 9/1965 | Bolduc | D8/18 |
| 3,305,924 | A | * | 2/1967 | Caravella | D8/18 |
| 3,602,396 | A | * | 8/1971 | Oates | D8/34 |
| 3,885,478 | A | * | 5/1975 | Evans | 81/3.55 |
| 4,034,595 | A | * | 7/1977 | Smith | 7/151 |
| D254,834 | S | * | 4/1980 | Madsen et al. | D8/18 |
| 4,213,215 | A | * | 7/1980 | Hall | 7/152 |
| 4,309,921 | A | * | 1/1982 | Miller | 81/3.57 |
| 4,330,894 | A | * | 5/1982 | Hayden | 7/152 |
| 4,409,863 | A | * | 10/1983 | Anderson | 7/151 |
| 4,412,464 | A | * | 11/1983 | Cook | D8/40 |
| D276,304 | S | * | 11/1984 | DiFede | D8/40 |
| D278,307 | S | * | 4/1985 | Birchenall | D8/18 |
| D282,714 | S | * | 2/1986 | Harvey | D8/40 |
| 4,617,842 | A | * | 10/1986 | Yang | 81/3.55 |
| D301,196 | S | * | 5/1989 | Price | D8/18 |
| D301,826 | S | * | 6/1989 | Tucker | D8/18 |
| 4,864,898 | A | * | 9/1989 | Tricinella | 81/3.55 |
| D304,992 | S | * | 12/1989 | Matthies | D8/40 |
| 4,967,436 | A | * | 11/1990 | Russell | 81/3.57 |
| 4,976,172 | A | * | 12/1990 | Thomas et al. | 81/3.55 |
| 5,077,850 | A | * | 1/1992 | Brubaker | 7/151 |
| D385,162 | S | * | 10/1997 | Barrick | D8/18 |
| D433,899 | S | * | 11/2000 | Saffron et al. | D8/18 |
| 6,199,452 | B1 | * | 3/2001 | Vinar | 81/3.57 |
| 6,354,174 | B1 | * | 3/2002 | Korwin | 81/3.55 |
| D466,768 | S | * | 12/2002 | Kelleghan | D8/18 |
| D466,769 | S | * | 12/2002 | Kelleghan | D8/18 |
| D466,770 | S | * | 12/2002 | Kelleghan | D8/40 |
| D467,480 | S | * | 12/2002 | Kelleghan | D8/40 |
| 6,640,369 | B1 | * | 11/2003 | Malvasio | 7/151 |
| D496,236 | S | * | 9/2004 | Marsden et al. | D8/18 |
| D509,456 | S | * | 9/2005 | Ricci et al. | D8/40 |
| 7,313,983 | B1 | * | 1/2008 | Book | 81/3.55 |
| D600,084 | S | * | 9/2009 | Hbaiu | D8/40 |
| 7,827,884 | B2 | * | 11/2010 | Lawson | 81/3.09 |
| 8,484,785 | B1 | * | 7/2013 | Kristiansen et al. | 7/151 |
| 8,695,457 | B2 | * | 4/2014 | Rozmus | B67B 7/24 81/3.09 |
| D707,507 | S | * | 6/2014 | Tran | D8/18 |
| 2005/0076742 | A1 | * | 4/2005 | Yurek et al. | 81/3.55 |
| 2006/0130613 | A1 | * | 6/2006 | Oleksy | 81/3.57 |
| 2007/0006685 | A1 | * | 1/2007 | Fok et al. | 81/3.55 |
| 2012/0285297 | A1 | * | 11/2012 | Rozmus et al. | 81/3.57 |
| 2014/0069065 | A1 | * | 3/2014 | Laverty | 30/450 |
| 2014/0237952 | A1 | * | 8/2014 | Fesler | 81/3.47 |

FOREIGN PATENT DOCUMENTS

| | | | | |
|---|---|---|---|---|
| FR | 2507571 | A1 | * | 12/1982 |
| FR | 2529874 | A1 | * | 1/1984 |
| GB | 456605 | A | * | 11/1936 |
| GB | 515315 | A | * | 12/1939 |
| GB | 793344 | A | * | 4/1958 |
| GB | 817288 | A | * | 7/1959 |
| GB | 877003 | A | * | 9/1961 |
| GB | 1012437 | A | * | 12/1965 |
| GB | 1103805 | A | * | 2/1968 |
| NL | 9401347 | A | * | 4/1996 |

* cited by examiner

BEVERAGE-OPENING TOOL

CLAIM OF PRIORITY

This application claims priority to U.S. Provisional Patent Application Ser. No. 61/891,808 filed Oct. 16, 2014, entitled "BEVERAGE-OPENING TOOL AND METHOD", which is hereby incorporated by reference.

FIELD OF INVENTION

The present invention relates to beverage-opening devices. More particularly, the present invention relates to a method and tool for opening beverage cans for the rapid consumption of their contents.

BACKGROUND OF THE INVENTION

The present invention fulfills a need for a tool that allows a drinker to "shotgun" a beverage with greater safety and cleanliness. "Shotgunning" is a means of consuming a canned beverage by a particular technique typically involving puncturing the side of the beverage can while under pressure.

The drinker tilts the can and punches a hole near the bottom of the can, typically puncturing the can through the small pocket of trapped air in the can. The drinker then places the resulting hole to their lips and tilts the can upright and opens the pull-top of the can. The combined effect of gravity and the pressurization change occurring when the pull-top of the can is operated causes the beverage to exit the can through the punctured hole and into the drinker's mouth very rapidly.

Prior techniques for puncturing the can involve the use of a sharp or improvised object such as a key or a knife. As a consequence, these prior techniques render the puncturing action dangerous, particularly when conducted in crowded areas, such as tailgating events and college gatherings. In particular, there is often significant difficulty safely securing the key or knife while drinking the beverage following the puncturing of the can. Furthermore, the prior techniques often leave dangerous sharp edges around the hole placed to the drinker's mouth.

Prior techniques are also ill-suited for providing a consistently shaped hole, often causing spillage of the beverage, particularly if the beverage is pressurized. Finally, the inconsistent shape of the punctured hole often forces the drinker to manually peel back sections of the can to enlarge the hole, occasionally lacerating the drinker's hands, particularly if the drinker is in a crowded environment and is thus subject to jostling by others.

Thus, there remains a need for a small, portable tool, suitable for use in crowded environments, having the advantages of safer puncturing, reduced spillage, and more uniform hole sizing.

SUMMARY OF THE INVENTION

In accordance with various aspects of the present invention, a tool and method for puncturing a beverage can to permit rapid consumption of the beverage is provided. In accordance with an exemplary embodiment, a tool for puncturing comprises a finger grip, a tooth portion, and an arm.

In accordance with an exemplary embodiment, a tool can be preformed for ready usage requiring neither user assembly nor adjustment.

In accordance with an exemplary embodiment, a tool can be configured for puncturing a beverage can wherein the tool enhances the user experience by comprising a finger grip and optional surface texturing to improve grippability.

In accordance with an exemplary embodiment, a tool can configured to puncture a beverage can wherein the tool further comprises a securement portion having a hole for securement to a key ring or lanyard or other carrying device.

Furthermore, some embodiments can provide a dual-purpose bottle opener also suited for opening bottled beverages having crimp-on lids.

Thus, a beverage-opening tool is provided. The beverage-opening tool may comprise a finger grip, a tooth portion, and an arm comprising a puncturing edge. The arm may connect the finger grip to the tooth portion. The arm may provide spacing between the tooth portion and the puncturing edge. Moreover, the tooth portion may include a fulcrum for rotating the beverage-opening tool to cause the puncturing edge to penetrate a beverage can. With reference to FIGS. 3, 4, and 9, the arcuate arm may have a tapering arm thickness and include a puncturing edge having a thickness greater than the tapering arm thickness and configured to puncture a beverage can. The puncturing edge may include a vertex of two planar surfaces extending from opposing longitudinal faces of the arcuate arm and toward one another. The vertex may be positioned closer to one longitudinal face of the arcuate arm than to the other longitudinal face of the arcuate arm whereby the puncturing edge includes an asymmetric triangle configured to concentrate a puncturing force of the puncturing edge against a beverage can;

A method of opening a beverage can is also provided. The method may include positioning a tooth portion of a beverage-opening tool in secure mechanical communication with a bottom surface the beverage can, positioning a puncturing edge of the beverage-opening tool in secure mechanical communication with a side surface of the beverage can, and rotating the beverage-opening tool, the tooth portion providing a fulcrum and the rotating causing the puncturing edge to penetrate the beverage can.

Furthermore, a method of enlarging a hole in a beverage can is disclosed. The method may include positioning a resting surface of a beverage-opening tool in mechanical communication with an interior bottom surface of the beverage can, and positioning a finger rest of the beverage-opening tool in mechanical communication with a side surface of the beverage can and contacting the side surface of the beverage can. The side surface of the beverage can may have the hole. The method may further include rotating the beverage-opening tool, the resting surface providing a fulcrum and the rotating causing the finger rest to bend the side surface of the beverage can proximate to the hole.

These and other features and advantages of the present invention will become apparent to a person having ordinary skill in the art from the following description and accompanying drawings.

BRIEF DESCRIPTION OF THE DRAWINGS

A more complete understanding of the present invention may be derived by referring to the detailed description and claims when considered in connection with the Figures, where like reference numbers refer to similar elements throughout the Figures, and:

DETAILED DESCRIPTION

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for manufacturing and construction may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical method of construction.

Figure 1:
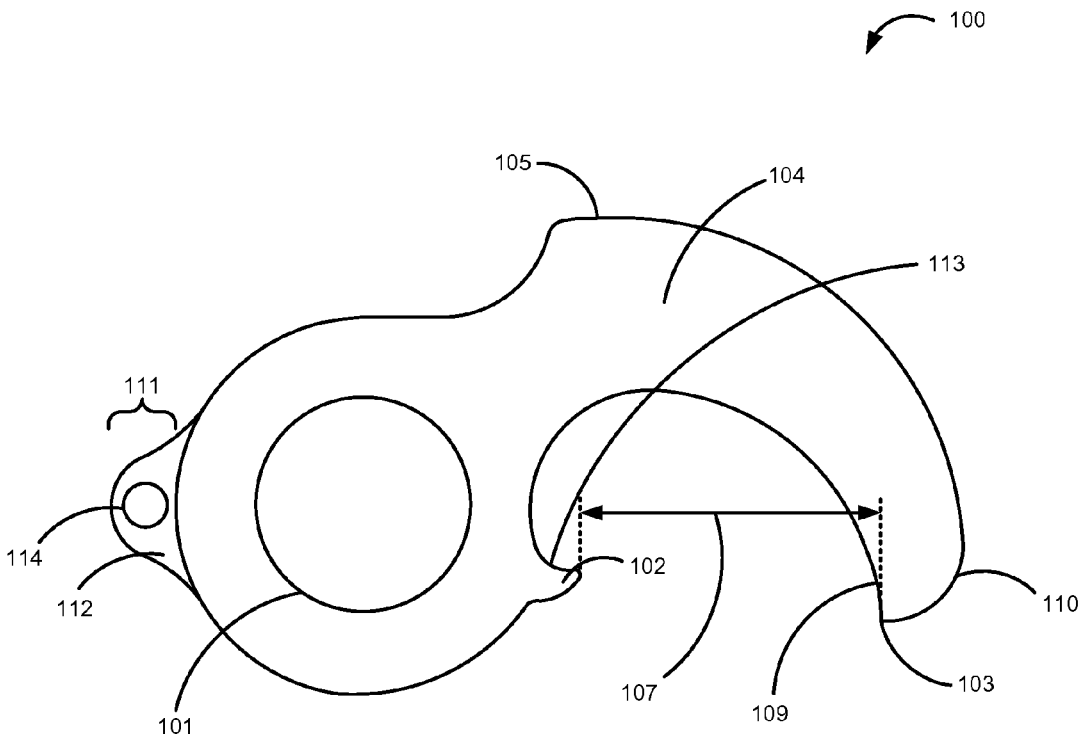
FIG. 1 is a side view of a beverage-opening tool having a transverse extending puncturing edge, in accordance with various embodiments.
Figure 3:
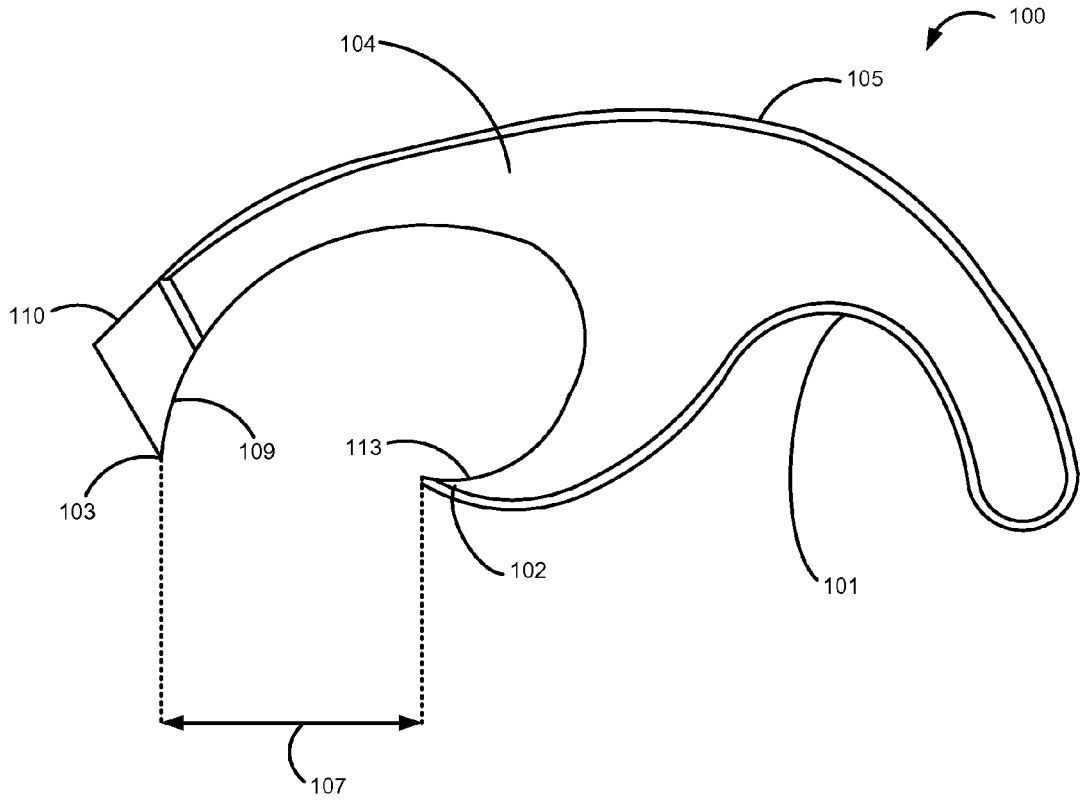
FIG. 3 is a side view of a beverage-opening tool having a puncturing edge comprising an asymmetric triangular edge, in accordance with various embodiments.
Figure 4:
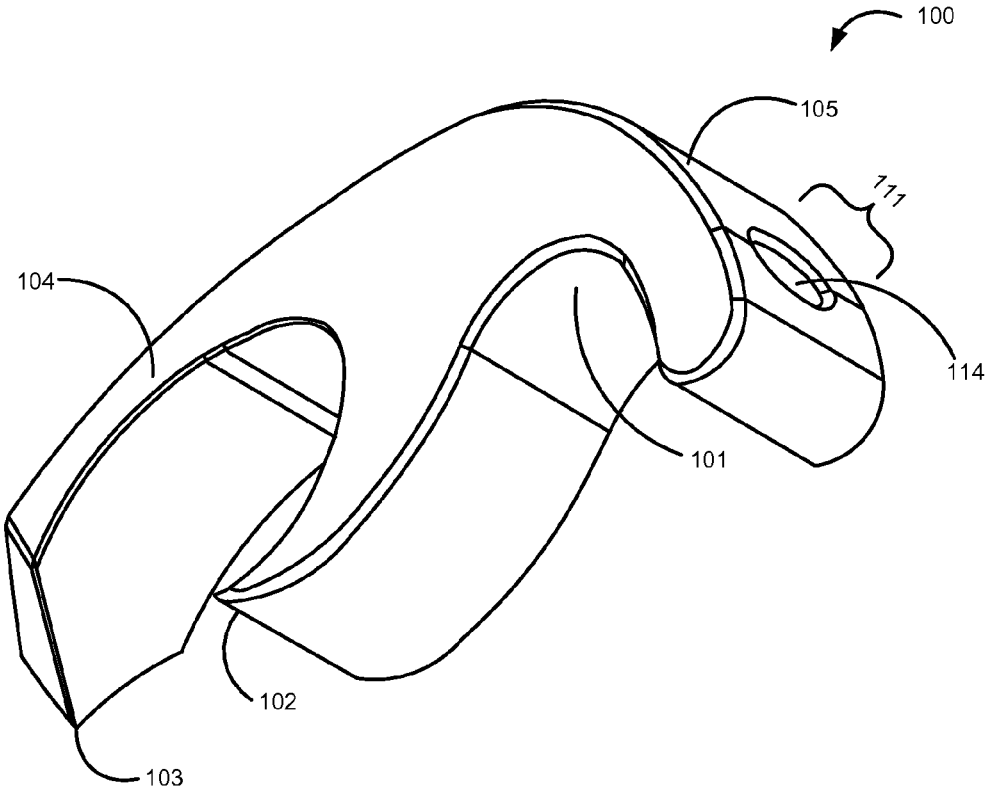
FIG. 4 is a rear view of a beverage-opening tool according to FIG. 3 in accordance with various embodiments.

Now, with reference to FIGS. 1, 3 and 4, a beverage-opening tool 100 may comprise a securement member 111, finger grip 101, a tooth portion 102 comprising an engagement face 113, and an arm 104. The arm 104 may further comprise a puncturing edge 103, a resting surface 110, and a finger rest 105.

Beverage-opening tool 100 may be made of aluminum. However, beverage-opening tool 100 may be made of any material adaptable for transmitting sufficient force for the tool to operate according to the modes described herein. For example, beverage-opening tool 100 may be made of metal, plastic, composites, wood, ceramics, or any combination of materials.

In various example embodiments, finger grip 101 may enable the user to comfortably grip the tool and may provide leverage for operation of the tool. For example, with reference to FIG. 1, in various embodiments, finger grip 101 may comprise a circular aperture disposed through beverage-opening tool 100 and configured to accept a user's finger. With reference to FIG. 3, in further embodiments, finger grip 101 may comprise a semicircular opening formed in the beverage-opening tool 100, for example, an open U-shaped channel disposed in the beverage-opening tool 100. Moreover, the finger grip 101 may be as small or large as needed to accommodate fingers of different sizes. Thus, the finger grip 101 may comprise various shapes such as circular, oval, or hexagonal, or any other closed or open shape, or any bar structure suitable to enable the user to comfortably grip the tool and to provide leverage for operation of the tool. In further embodiments, finger grip 101 may further comprise texturing, ridging, rubber, or any other texturing or frictional material adapted to enhance grippability.

With continuing reference to FIGS. 1, 3, and 4, the beverage-opening tool 100 may be used for puncturing a beverage can. Finger grip 101 may be utilized to aid in steadying the tool. For example, the user may grasp finger grip 101 in order to securely guide the tool along a desired path of motion. For example, a user may grasp finger grip 101 and may rotate the tool about a normal axis of the tool face represented in FIGS. 1 and 3 so as to bring puncturing edge 103 into mechanical contact with the beverage can. Thus, the beverage-opening tool 100 may travel through a plane parallel to a face of the beverage-opening tool 100 illustrated in FIGS. 1 and 3. Furthermore, a user may grasp finger grip 101 and translate the tool body forward or aft or alternatively rotate the tool about a normal axis of the tool face represented in FIGS. 1 and 3, or any other axis, such as when enlarging a hole punctured in a beverage can.

Figure 5:
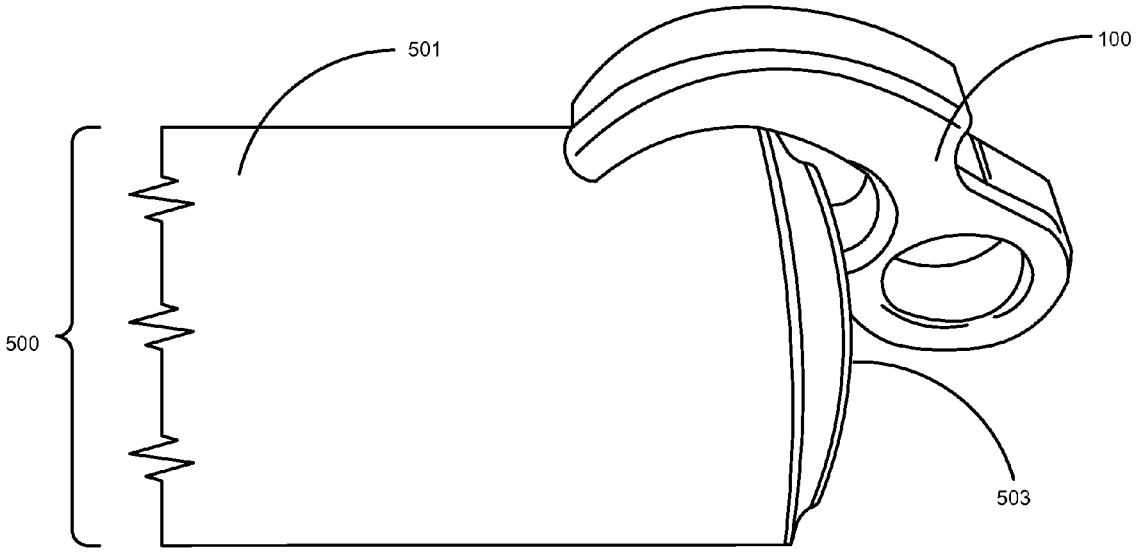
FIG. 5 is a view of a beverage-opening tool being used to puncture a beverage can wherein the beverage-opening tool is positioned on the can prior to puncturing the beverage can, in accordance with various embodiments.
Figure 6:
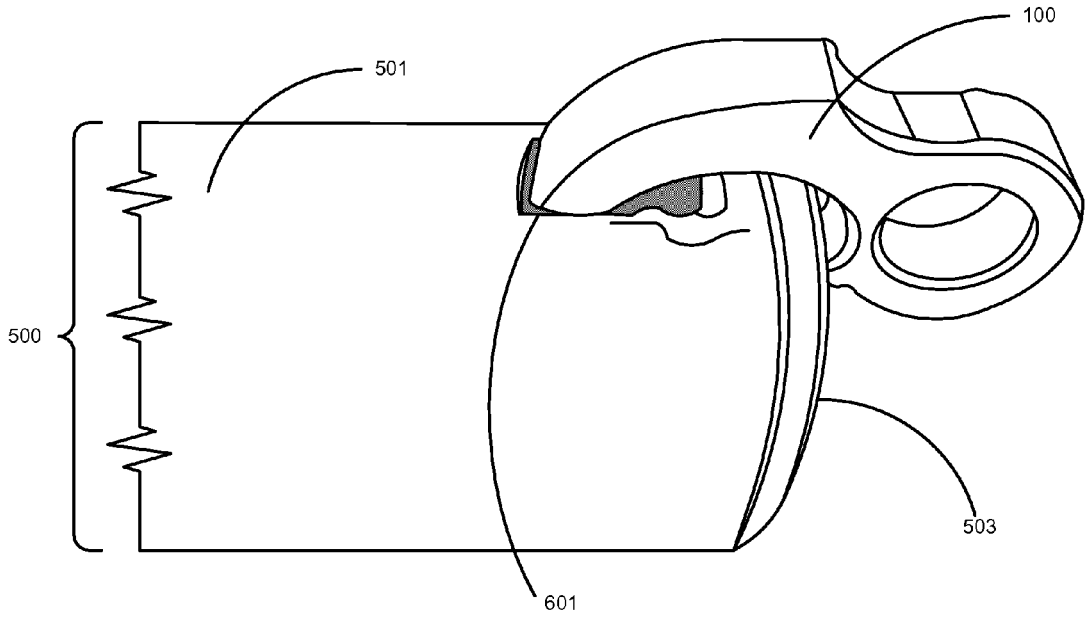
FIG. 6 is a view of a beverage-opening tool being used to puncture a beverage can wherein the tool is positioned on the can after puncturing the beverage can, in accordance with various embodiments.

With reference to FIG. 5, an illustration is provided of beverage-opening tool 100 wherein the tool is positioned on a beverage can 500 immediately prior to operation of the tool. With reference to FIG. 6, an illustration is provided of an example embodiment of a beverage-opening tool 100 wherein the tool has been operated to puncture a beverage can 500. As illustrated, a shotgunning aperture 601 may be formed in the beverage can 500 in response to the beverage-opening tool 100 being operated according to various methods such as those disclosed herein.

Figure 8:
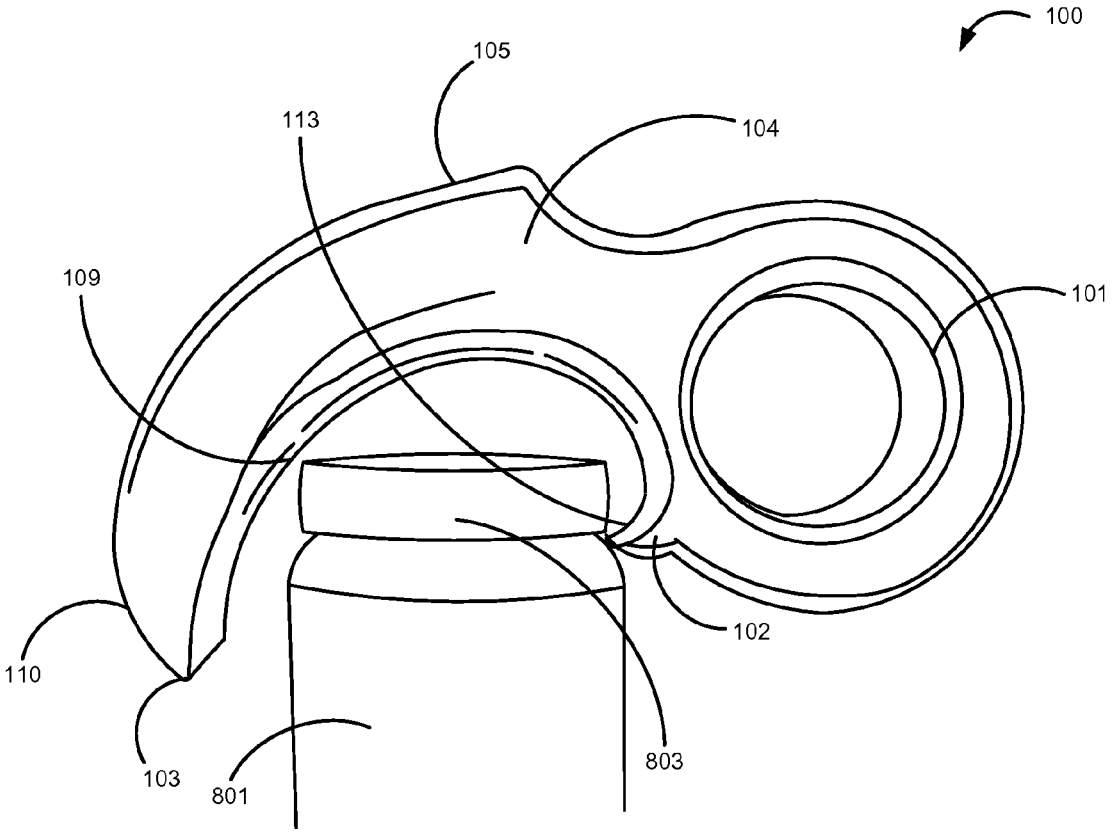
FIG. 8 is a view of a beverage-opening tool being positioned to remove a crimp-on lid from a beverage bottle, in accordance with various embodiments.
Figure 9:
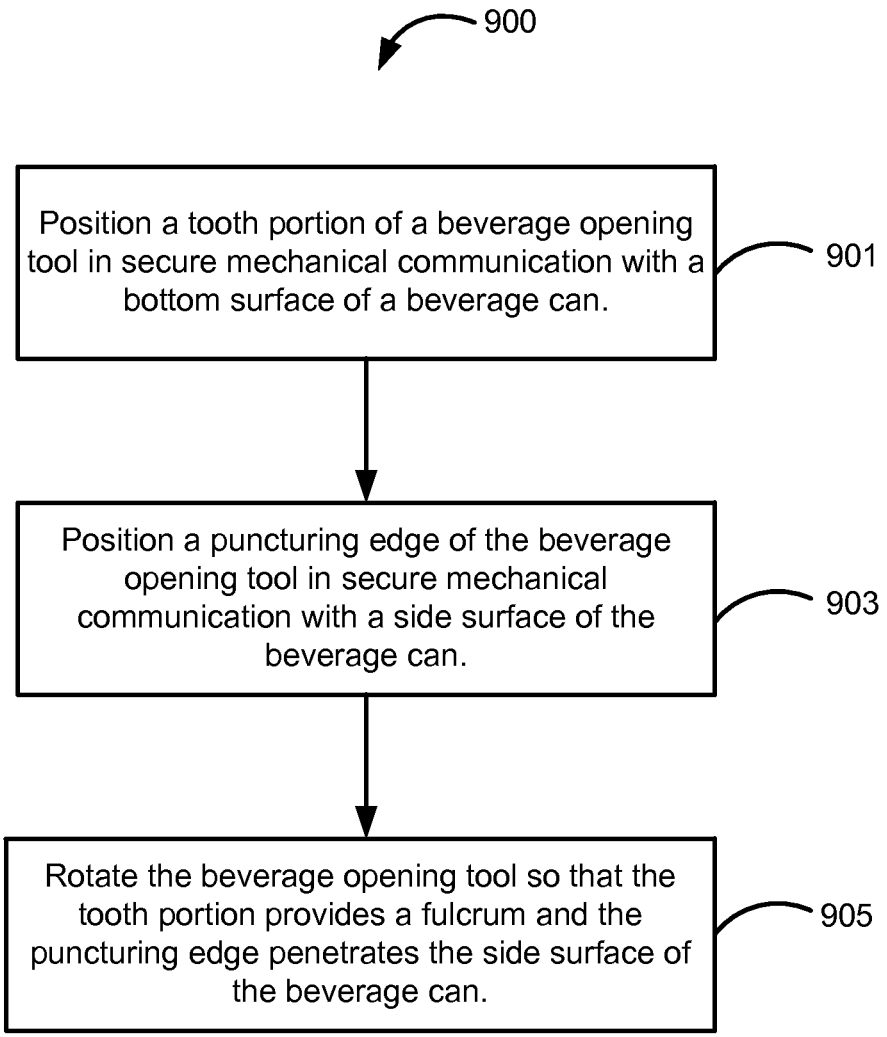
FIG. 9 depicts a flow illustrating a method of opening a beverage can by a beverage-opening tool.
Figure 10:
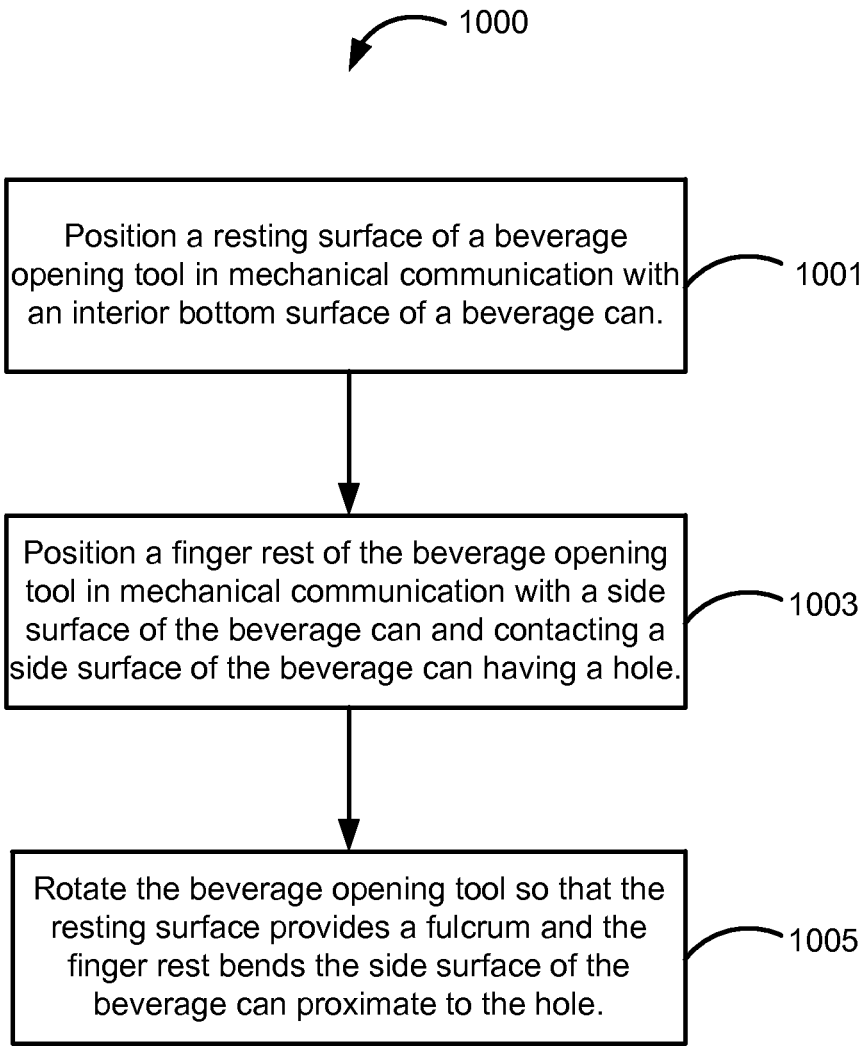
FIG. 10 depicts a flow chart illustrating a method of enlarging a hole in a beverage can by a beverage-opening tool, in accordance with various embodiments.

With reference to FIG. 8, in various instances, a beverage-opening tool 100 may further be used to remove a bottle cap 803 from a beverage bottle 801. In this instance, the finger grip 101 may be gripped to permit the user to forcibly rotate the tool, pulling the cap from the beverage. Furthermore, the finger grip 101 multiplies the force exerted, easing the cap removal process. For example, the user may insert their finger into the finger grip 101, and may further rest a portion of their hand on finger rest 105. The user may further rotate the tool about a normal axis of the tool face represented in FIGS. 1 and 3. Furthermore, the user may engage in any other motion suited to removing a bottle cap 803 from a beverage bottle 801.

With renewed reference to FIGS. 1 and 3, as well as FIGS. 5-6, the tool may be used for puncturing a beverage can 500. The tooth portion 102 may contact the bottom surface 503 of a beverage can 500, and may provide a fulcrum about which the tool can be rotated during use to puncture the beverage can 500 to create a shotgunning aperture 601. Tooth portion 102 may comprise any shape or sharpness suited for retention of the tool in mechanical contact with the bottom surface 503 of the beverage can. Tooth portion 102 holds the tool in secure mechanical communication with the bottom surface 503 of the beverage can 500. In this manner, the tooth portion 102 enables the tool to travel through a plane parallel to the tool face represented in FIGS. 1 and 3 and enables the tool to rotate about a normal axis of this tool face. The tooth portion 102 provides the fulcrum about which this rotation may be focused. In various embodiments, tooth portion 102 may be chamfered about the edges and may comprise a beverage can engagement face 113 which curves upward toward arm 104, enhancing the security of the mechanical communication between the bottom surface 503 of the beverage can 500 and the tooth portion 102.

Tooth portion 102 may be located an appropriate first distance 107 from puncturing edge 103 so as to allow the tool to pivot about tooth portion 102 and cause puncturing edge 103 to puncture the can 500 to create a shotgunning aperture 601 at a proper place to facilitate ease of drinking. For example, in one embodiment, tooth portion 102 may be located a first distance 107 of approximately 1" inch (+1-0.5 inch) from puncturing edge 103. Accordingly, the puncturing edge 103 may penetrate a side surface 501 of the beverage can 500 while the tooth portion 102 engages in secure mechanical communication with the bottom surface 503 of the beverage can 500.

With reference to FIG. 8, tooth portion 102 may have the further function of grasping a bottle cap 803 of a beverage bottle 801 during the application of removal force to pull the bottle cap 803 from the beverage bottle 801. Tooth portion 102 may comprise any shape or sharpness suited for retention of the tool in mechanical contact with the bottle cap 803 during the application of removal force. For example, as illustrated in FIGS. 1, 3 and 8, tooth portion 102 may be chamfered about the edges and may comprise an engagement face 113. Engagement face 113 may comprise a face of the tooth portion 102 that curves toward the arm 104 of the beverage-opening tool 100. In this manner, the engagement face 113 may enhance the retention of the tooth portion 102 against the bottle cap 803.

Figure 2:
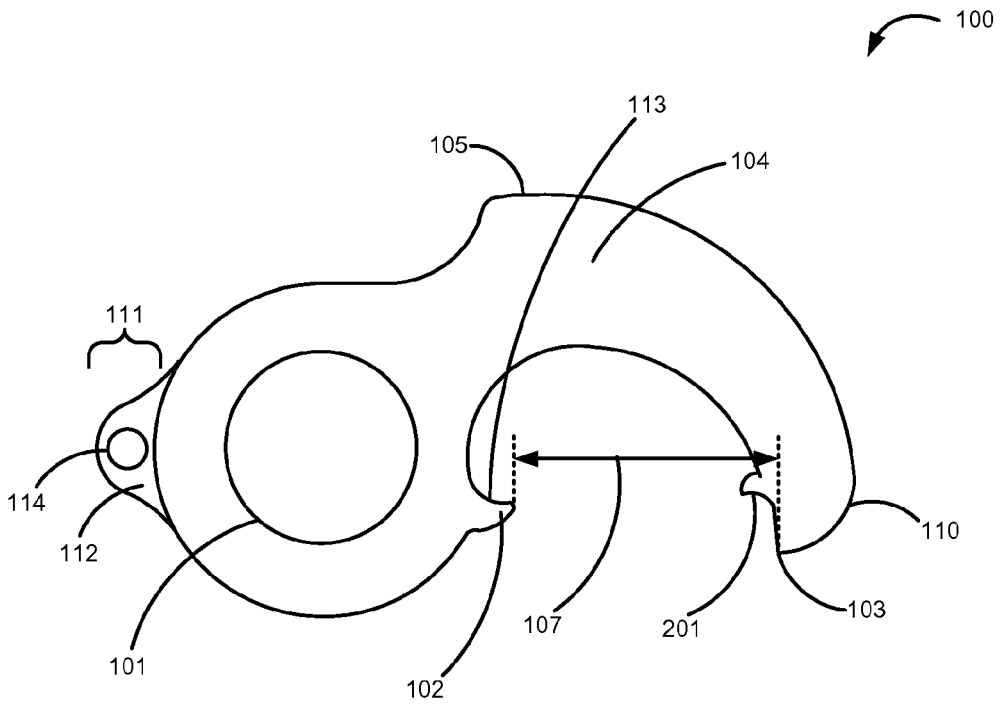
FIG. 2 is a side view of a beverage-opening tool further comprising a cap hook, in accordance with various embodiments.

With reference now to FIG. 2, in further embodiments, a beverage-opening tool 100 may also comprise a cap hook 201. A cap hook 201 may comprise a hook shaped portion of the arm 104 extending toward the tooth portion 102. The cap hook 201 may provide a fulcrum about which the tool may be rotated during the removal of a bottle cap from a beverage bottle. For example, tooth portion 102 may be engaged in mechanical communication with the bottle cap of a beverage bottle. Cap hook 201 may be rested on the top surface of the bottle cap. Removal force may be applied to rotate the tool about cap hook 201. As the tool rotates, tooth portion 102 may mechanically communicate a removal force to said bottle cap, pulling it from the bottled beverage while cap hook 201 may provide the fulcrum about which the tool rotates.

With reference again to FIGS. 1, 3, and 8, in other example embodiments, cap hook 201 (See FIG. 2) may be omitted. The beverage-opening tool 100 may comprise a cap surface 109. Cap surface 109 may comprise a section in arm 104 that mechanically contacts a bottle cap 803 during removal of the bottle cap 803. Cap surface 109 may rest on the bottle cap 803. Cap surface 109 may operate as a fulcrum during the application of removal force to pull the bottle cap 803 from the bottle. For example, tooth portion 102 may engage in mechanical communication with the bottle cap 803 of a beverage bottle 801. Cap surface 109 may be rested on the top surface of said bottle cap 803. Removal force may be applied to rotate the tool about cap surface 109. As the tool rotates, tooth portion 102 may mechanically communicate a removal force to said bottle cap 803, pulling it from the beverage bottle 801 while cap surface 109 may provide the fulcrum about which the tool rotates. With reference to FIG. 8, an illustration is provided of one example embodiment of a beverage-opening tool 100 wherein the tool is positioned on a beverage bottle 801 immediately prior to operation of the tool.

With reference again to FIGS. 1, 3, and 4, puncturing edge 103 may be pointedly shaped in order to puncture a beverage can. For example, the shape may be gradually tapered, or may be steeply tapered, or may taper asymmetrically or may be any other shape suitable to puncture a beverage can. As shown in FIG. 1, a puncturing edge 103 may comprise a single non-discontinuous line segment extending transverse to the face of the tool illustrated in FIG. 1 (e.g., the "longitudinal face"). As shown in FIG. 1, in various embodiments, the transverse line segment may extend along a normal axis of the longitudinal face of the tool. In further embodiments, a puncturing edge 103 may comprise any shaped edge. For instance, as shown in FIGS. 3 and 4, the puncturing edge 103 may comprise an asymmetric triangle. Thus, rather than comprising a single non-discontinuous line segment extending transverse to the longitudinal face of the tool, the puncturing edge 103 may be comprise one or more bend, turn, or point of inflection. For example, the puncturing edge 103 may comprise a vertex of two line segments each extending from an opposing longitudinal face of the tool toward one another, and forming two sides of a triangle. Moreover, the line segments may be of different lengths, thus causing the vertex to be positioned closer to one longitudinal face of the tool than to the other longitudinal face of the tool. Thus, the puncturing edge 103 may comprise an asymmetric triangle. However, the vertex may alternatively be centered between the longitudinal faces of the beverage-opening tool 100 so that the two line segments extending from opposing longitudinal faces of the beverage-opening tool 100 toward one another are the same length. Thus, the puncturing edge 103 may comprise a symmetric triangle. In further embodiments, the puncturing edge 103 may comprise any shape adapted to puncture a beverage can.

Figure 7:
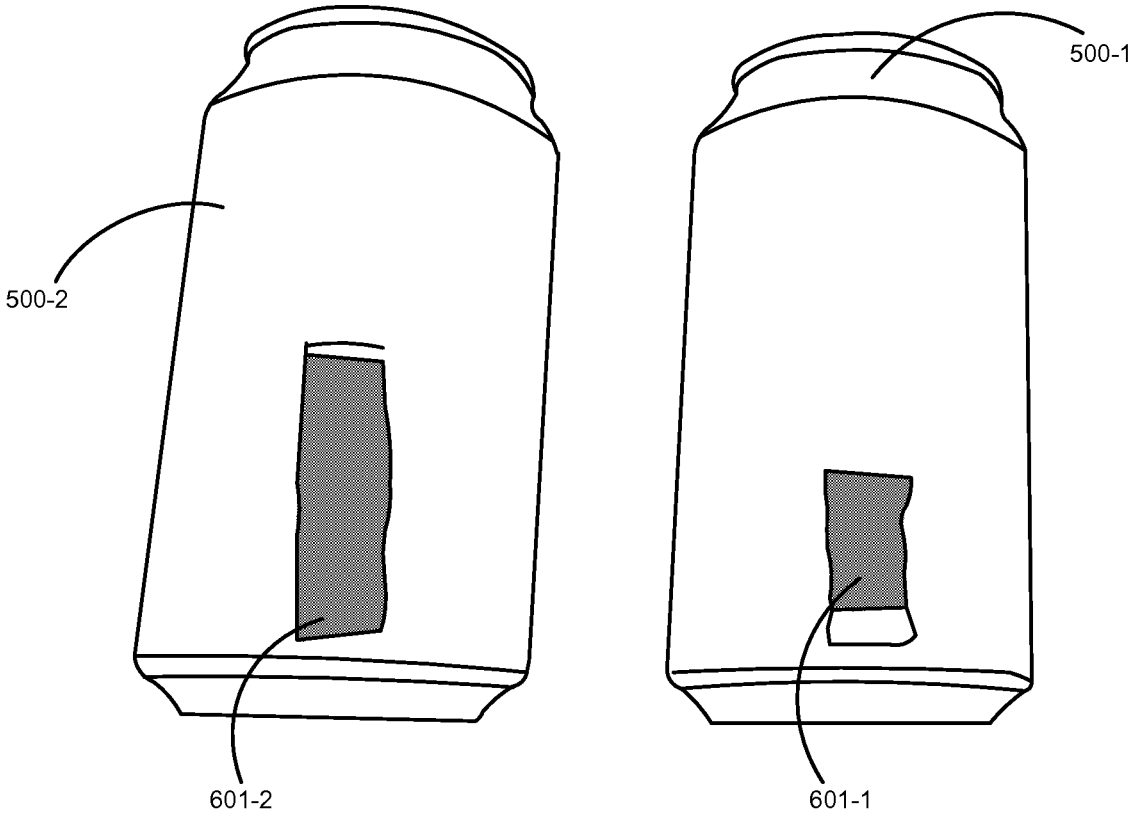
FIG. 7 illustrates the flexible capability of a beverage-opening tool to puncture beverage cans with holes of various dimensions, in accordance with various embodiments.

Referring to FIGS. 1 and 3, and as discussed, the beverage-opening tool 100 may be used for puncturing a beverage can and may further be used for enlarging a hole previously punctured in a beverage can. After the beverage can is punctured, a resting surface 110 may be rested against the interior bottom of the can (e.g, the reverse side of bottom surface 503 of the can 500) (See FIG. 5). Resting surface 110 comprise any surface capable of being rested against the interior bottom of the can (e.g., the reverse side of bottom surface 503 of the can 500) (See FIG. 5). Resting surface 110 may further serve as a fulcrum about which to rotate the beverage-opening tool 100 while finger rest 105 is pressed against the side of the beverage can to enlarge the shotgunning aperture. With reference to FIG. 7, the capability of one example embodiment of a beverage-opening tool 100 to enlarge the punctured hole is illustrated. For instance, a first beverage can 500-1 may comprise a first shotgunning aperture 601-1 formed by a beverage-opening tool 100 used for puncturing the first beverage can 500-1. A second beverage can 500-2 may comprise a second shotgunning aperture 601-2 formed by a beverage-opening tool 100 used to enlarge a shotgunning aperture previously punctured in the beverage can.

With reference again to FIGS. 1, 3, and 5, in some embodiments, arm 104 of the tool may operate as a lever allowing puncturing edge 103 to be pressed against a side surface 501 of the beverage can 500 for puncturing of the side surface 501 of the beverage can 500. Furthermore, arm 104 may provide a lever between finger grip 101 and puncturing edge 103. This enables the tool to puncture a beverage can. Still further, arm 104 may provide a lever extension from finger grip 101 which may multiply the force exerted by the user and communicated upon the beverage bottle 801 (See FIG. 8) or beverage can 500 being opened.

Arm 104 may comprise an arc-shape. The arm 104 may provide clearance for the tool to rotate. Furthermore, arm 104 may be any shape that provides clearance for the tool to rotate. For example, in some embodiments, arm 104 may be angularly shaped, may be bent, may have multiple bends, or may comprise any shape suitable to enable the tool to rotate. Furthermore, arm 104 may have constant thickness, or may taper gradually, or may taper steeply, or may taper asymmetrically, or may have any other shape or thickness suitable to enable puncturing edge 103 to puncture the side surface 501 of a beverage can 500 while the tooth portion 102 engages in secure mechanical communication with the bottom surface 503 of the beverage can 500.

With momentary additional reference to FIG. 8, in some embodiments, arm 104 of the tool may operate as a lever allowing tooth portion 102 to exert a multiplied removal force upon a bottle cap 803. For example, arm 104 may have various length, width and height chosen to allow the tool to interface with a chosen variety of beverage can 500 (See FIG. 5) or beverage bottle 801.

In some embodiments, finger rest 105 of arm 104 may provide the user with a convenient place to rest their finger will operating the tool. Furthermore, in some embodiments, finger rest 105 may further comprise texturing, ridging, rubber, plastic, or any other texturing or frictional material adapted to enhance grippability. With reference to FIG. 1, in various embodiments, finger rest 105 comprises a raised portion of arm 104. With reference to FIG. 3, in further embodiments, finger rest 105 is not raised, but comprises a portion of arm 104. As such, finger rest 105 may comprise any desired shape.

With reference to FIGS. 1 and 4, the beverage-opening tool 100 may further comprise a securement member 111. A securement member 111 may comprise an aperture 114 whereby the user to attach the tool to a carrying article. For example, with reference to FIG. 1, securement member 111 may comprise an aperture 114 disposed in a boss 112 attached proximate to the finger grip 101. With reference to FIG. 4, securement member 111 may comprise an aperture 114 disposed through a surface of the finger grip 101 of the beverage-opening tool 100, for example extending longitudinally outward through the body of the beverage-opening tool 100 proximate to the finger grip 101. In further embodiments, the securement member 111 may comprise any aperture or device for insertion of a key ring, lanyard, or any other article to which the user wishes to attach the tool. Furthermore, securement member 111 may comprise a hook or notch or other structure adapted to allow the user to carry the tool.

A beverage-opening tool 100 may be used in accordance with various methods. For example, with reference to FIGS. 1-8, and FIG. 9, a method 900 of opening a beverage can may include several steps. A user may position a tooth portion 102 of a beverage-opening tool 100 in secure mechanical communication with a bottom surface 503 of a beverage can 500 (Step 901). The user may further position a puncturing edge 103 of the beverage-opening tool 100 in secure mechanical communication with a side surface 501 the beverage can 500 (Step 903). The user may rotate the beverage-opening tool 100 so that the tooth portion 102 provides a fulcrum and so that the puncturing edge 103 penetrates the side surface 501 of the beverage can 500 (Step 905), such as in a first beverage can 500-1 as illustrated in FIG. 6 to form a first shotgunning aperture 601-1.

Furthermore, with reference to FIGS. 1-9, and FIG. 10, a beverage-opening tool 100 may be used according to a method 900 of enlarging a hole in a beverage can. A user may position a resting surface 110 of a beverage-opening tool 100 in mechanical communication with an interior bottom surface (the opposite face of side surface 501) of a beverage can 500 (Step 1001). The user may position a finger rest 105 of the beverage-opening tool 100 in mechanical communication with a side surface 501 of the beverage can 500 so that the finger rest 105 contacts the side surface 501 of the beverage can 500 having a hole (Step 1003). The user may then rotate the beverage-opening tool 100 so that the resting surface 110 provides a fulcrum and so that the finger rest 105 bends the side surface 501 of the beverage can 500 proximate to the hole, enlarging the hole (Step 1005), such as in a second beverage can 500-2 as illustrated in FIG. 6 to form a second shotgunning aperture 601-2. Moreover, one will further appreciate that various steps of FIG. 9 and FIG. 10 may be combined in various sequences, for example, to first open a beverage can by forming a shotgunning hole, and to then enlarge the shotgunning hole, as desired.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "proximate," "proximately," or any other variation thereof, are intended to cover a physical connection, an electrical connection, a magnetic connection, an optical connection, a communicative connection, a functional connection, and/or any other connection. When language similar to "at least one of A, B, or C" is used, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

The invention claimed is:

1. A beverage-opening tool comprising:

a finger grip;

a tooth portion; and an arcuate arm having a tapering arm thickness and comprising:

a puncturing edge comprising a thickness greater than the tapering arm thickness and configured to puncture a beverage can, wherein the puncturing edge comprises a vertex of two planar surfaces extending from opposing longitudinal faces of the arcuate arm and toward one another, wherein the vertex is positioned closer to one longitudinal face of the arcuate arm than to the other longitudinal face of the arcuate arm whereby the two planar surfaces and the vertex define an asymmetric triangle shape configured to concentrate a puncturing force of the vertex against a beverage can;

wherein the arcuate arm connects the finger grip to the tooth portion, wherein the arcuate arm provides a first distance between the tooth portion and the vertex, the tooth portion configured to operate as a fulcrum against the beverage can for rotating the beverage-opening tool to cause the vertex to penetrate the beverage can.

2. The beverage-opening tool of claim 1, further comprising a securement aperture defined through a surface of the finger grip.

3. The beverage-opening tool of claim 1, wherein the finger grip and tooth portion define an open U-shaped channel disposed in the beverage-opening tool.

4. The beverage-opening tool of claim 1, wherein the first distance comprises one inch.

5. The beverage-opening tool of claim 1, wherein the beverage-opening tool is made of aluminum.

6. The beverage-opening tool of claim 1, wherein the tooth portion comprises chamfered edges.

7. The beverage-opening tool of claim 1, wherein the tooth portion comprises an engagement face curving toward the arcuate arm.

* * * * *